US007358839B2

(12) United States Patent
Mikl

(10) Patent No.: US 7,358,839 B2
(45) Date of Patent: Apr. 15, 2008

(54) HEAVY DUTY RELAY WITH RESILIENT NORMALLY-OPEN CONTACT

(75) Inventor: Rudolf Mikl, Arbesthal (AT)

(73) Assignee: Tyco Electronics Austria GmbH, Vienna (AT)

( * ) Notice: Subject to any disclaimer, the term of this patent is extended or adjusted under 35 U.S.C. 154(b) by 229 days.

(21) Appl. No.: 11/046,313

(22) Filed: Jan. 28, 2005

(65) Prior Publication Data

US 2005/0190026 A1 Sep. 1, 2005

(30) Foreign Application Priority Data

Jan. 28, 2004 (EP) ..... 04001861

(51) Int. Cl.
*H01H 51/22* (2006.01)

(52) U.S. Cl. ..... 335/78; 335/83; 200/283

(58) Field of Classification Search ..... 335/78–86, 335/129–131, 83; 200/282–283, 61.74, 61.76, 200/450–454, 462
See application file for complete search history.

(56) References Cited

U.S. PATENT DOCUMENTS 5,719,541 A * 2/1998 Mader ..... 335/78
6,606,018 B2 * 8/2003 Takano et al. ..... 335/78

FOREIGN PATENT DOCUMENTS

EP 0691667 B1 1/1996

* cited by examiner

*Primary Examiner*—Elvin Enad
*Assistant Examiner*—Bernard Rojas
(74) *Attorney, Agent, or Firm*—Barley Snyder

(57) ABSTRACT

A heavy duty relay can safely switch a current of 40 A to 1 kA. The heavy duty relay is provided with a changeover spring which can be resiliently deflected by means of a switching force and with a normally-open contact, against which a contact point of the changeover spring is electrically conductively pressed in a switching position. The normally-open contact is arranged on a normally-open spring contact, which exhibits a higher spring stiffness than the changeover spring and is resiliently deflected in the switching position, and the changeover spring and/or the normally-open spring contact comprises a deflection region at least partially surrounded by a weakened zone. The spring stiffness of the deflection region is reduced relative to the region of the changeover spring and/or the normally-open spring contact surrounding the weakened zone.

20 Claims, 3 Drawing Sheets

3
18a
18b
M
21
5
19
22

3
18b
M
5
18a 3
18a
M
18b
5

3
M
5
18b
19
18a
23

3
18a
18b
M
5

3
18b
M
5
18a 3
18a
M
5
18b

3
M
5
18b
18a

HEAVY DUTY RELAY WITH RESILIENT NORMALLY-OPEN CONTACT

FIELD OF THE INVENTION

The invention relates to a heavy duty relay through which a current of at least 40 A and up to about 1 kA can be switched, and more particularly to a relay with a changeover spring that can be resiliently deflected by means of a switching force and with at least one normally-open contact against which a contact point of the changeover spring is electrically conductively pressed in a switch position.

BACKGROUND

Heavy duty relays are used when a very high inrush current between 40 A and 1 kA has to be produced. In the prior art, at this high inrush current, starter relays are used with a tungsten contact. For switching, firstly the tungsten contact is closed, so that the high current peak flows over it. Only after this an AgSnO contact closes which conducts the current in the contact point. In this embodiment it is avoided that, with closed relays, the current flows exclusively via the tungsten contact which has poor conductive properties.

The switching force is produced in the heavy duty relay by electromagnetic means, such as a switching current conducted by a coil. An electromagnetic force results therefrom which pulls a movable armature, the armature movement being transmitted to a changeover spring which is resiliently deflected from its resting position by the switching force. If the switching force is discontinued, the changeover spring springs back again into the resting position. The changeover spring is provided with a changeover contact which is pressed in the contact position against the normally-open contact which is arranged on a rigid support and produces a conductive connection. The compressive force is either produced by the resilient return force of the changeover spring or by the switching force. With a heavy duty relay with a tungsten contact and an AgSnO contact, the two changeover contacts are arranged on the changeover spring; corresponding normally-open contacts made from tungsten and AgSnO are associated with these contacts on a rigid support.

This construction is problematical in that the tungsten contact is very expensive due to the material costs and in that the tungsten is hard to machine due to its hardness. Moreover, the additional AgSnO contact is required. As a result, the solutions known from the prior art for switching high current in the region of between 40 A and 1 kA are complex and expensive.

A relay is disclosed in EP-B-0691667 with a normally-open contact arranged on a rigid contact support which is not deflected in the contact position. It has been established in tests that with the relay of EP-B-0691667 only a very low number of switching operations can be achieved at high currents, i.e. the relay is irreparably damaged after a number of switching processes which is too low to be practical.

A further relay for switching current considerably below 40 A is known. With this relay a fixed and a movable spring contact are constructed identically to one another in the form of a changeover spring and a normally-open spring contact and they are used mirror inverted in a plane in a base of the relay. Due to their identical construction the two spring contacts have, by necessity, identical spring stiffness, which at inrush currents of between 40 A and 1 kA leads to only a low number of switching operations, which in practice does not allow use for inrush currents over 40 A.

SUMMARY

The object of the invention therefore is to create a heavy duty relay which is of simple construction, can be manufactured at a low cost and can be marketed at a low price.

This object is achieved according to the invention for a relay of the aforementioned type in that the normally-open contact is arranged on a resiliently deflectable normally-open spring contact, of which the spring stiffness is greater than the spring stiffness of the changeover spring and which in the switching position is resiliently deflected out of its resting position and in that the changeover spring and/or the normally-open spring contact comprises a deflection region at least partially surrounded by a weakened zone, and of which the spring stiffness is reduced relative to the region surrounding the weakened zone of the changeover spring and/or the normally-open spring contact.

This solution is of simple construction and has the advantage that high current can be safely switched with a large number of switching operations, i.e. repeatedly after one another, without damage or failure. The number of switching operations which can be achieved with the solution according to the invention at 170 A, for example, is in the region of 15,000. With conventional relays such a number of switching processes at high inrush currents cannot be achieved.

Only by arranging the normally-open contact on a resiliently deflectable normally-open spring contact with higher spring stiffness than the changeover spring and the weakened region, can a higher number of switching operations be reached than with the two relays of EP-B-0691667 and DE-C-19718935, without a tungsten contact or a tungsten starter relay being necessary.

The spring stiffness of the deflection region is reduced relative to the other spring contacts by means of the weakened zone. As a result, the deflection region deforms more easily than the other spring contact and allows a stepped or progressive spring characteristic, as under the action of the switching force the deflection region is first deflected and only then is the rest of the contact field in the region of the clamping deflected. In this manner a gradual, more flexible switching process can be achieved, where sparking is largely avoided.

In an advantageous embodiment the spring stiffness of the normally-open spring contact corresponds at least to the spring stiffness of the changeover spring. In particular the spring stiffness can be at least 1.5 times or at most approximately 8 times the spring stiffness of the changeover spring. By means of the more flexible embodiment of the changeover spring, smaller switching forces are required for its deflection, so that smaller designs of relays can be manufactured. If the ratio of the spring stiffness of the changeover spring to the normally-open spring contact is in the aforementioned region, the normally-open spring contacts are only slightly deflected by the switching force. Chatter of the normally-open contact and the ensuing sparking at high current is reliably avoided with the indicated spring thickness.

With a spring stiffness of the normally-open spring contact which lies between approximately 3.5 and 5.5 times the spring stiffness of the changeover spring, an even higher number of switching operations appears to be achievable than in the above-mentioned range of stiffness ratios. In this connection, the spring stiffness appears to be fundamental in determining the deflection of the contact points. Different levels of spring stiffness can for example be achieved when the material thickness of the normally-open spring contact is, relative to the material thickness of the changeover spring, preferably at most 6 times, more preferably approximately double to approximately 1.5 times the material thickness of the changeover spring. According to the invention a normally-open spring contact is provided with a material thickness of between 0.2 and 0.3 mm, preferably in the region of 0.25 mm. The changeover spring contact can have a material thickness of approximately 0.15 mm.

The changeover spring and/or the normally-open spring contact can both be constructed in the form of leaf springs, of which one end facing away from the respective contact point is held or anchored in the relay, so that the spring bends resiliently in the region between the clamped end and the contact point when the contact point is deflected. In particular, with the changeover spring the switching force can be introduced into the spring at the free end, so that lower switching forces are required due to the more advantageous lever conditions for deflecting the spring and for pressing the changeover contact onto the normally-open contact. The force introduction into the changeover spring preferably takes place symmetrically, for example by means of two levers acting level with the contact point and spaced the same distance apart from the central axis of the spring.

The switching force can be produced by electromagnetic means by an electromagnetic coil which when actuated pulls an armature with the switching force. The movement of the armature can be transmitted to the changeover spring by means of a coupling element.

In order to be able to build the relay compactly, the coil is preferably arranged between the armature and the changeover spring, and a movable coupling part may be provided parallel to the coil core, in order to transmit the movement of the armature to the changeover spring.

A further series of further advantageous embodiments is concerned with the configuration of the deflection region which is at least partially surrounded by the weakened zone. Thus in the deflection region a contact point or contact bead can be arranged. The weakened zone can for example be constructed in the form of material erosion, such as a thinned area or a slot.

Preferably the weakened zone is arranged between the point or points of introduction of the switching force into the changeover spring and the contact point.

The weakened region can be constructed by means of local material erosion, such as for example locally reducing the wall thickness or a slot extending through the spring.

During the switching process, during the deflection of the changeover spring and the normally-open spring contact, in order to achieve a self-cleaning action of the contact points, at least one of the contact points can be constructed as a substantially spherical contact bead and the weakened region arranged asymmetrically on the changeover spring and/or the normally-open spring contact. The spherical construction of the contact bead leads to a rolling movement during the switching process which is reinforced by the asymmetrical arrangement of the weakened region and the asymmetrical deformation of the changeover spring and/or the normally-open spring contact resulting therefrom.

With a weakened region in the form of a slot, the slot can be arranged asymmetrically to produce a rolling movement of the contact bead, for example with a large part of its length, solely on one face of the contact bead. By this measure the spring stiffness of the spring contact is distributed asymmetrically, so that the deflection region relative to the contact bead is deformed asymmetrically in the switching position.

A particularly flexible switching process can be achieved when the slot of the weakened region extends as far as the edge, so that the freedom of movement of the contact bead is increased. In this embodiment the deflection region forms a more easily adjustable tab.

By means of the deflection region the further movement of the spring which is held fast can be absorbed in a particularly advantageous manner. By "further movement" it is understood that a movement is introduced into the changeover spring which would move it out over the position of the normally-open spring contact. The further movement is absorbed by the deformation of the changeover spring and the normally-open spring contact. By the further movement the life of the relay is extended, as the material in the region of the contact points or contact beads is equally eroded.

The contact bead is preferably made from AgSnO. The changeover spring and the normally-open spring contact preferably each have a single contact bead.

BRIEF DESCRIPTION OF THE DRAWINGS

Different embodiments of the heavy duty relay according to the invention will, for example, be described hereinafter with reference to the drawings. In this connection the same reference numerals are used for the same or similar elements relative to the construction and/or the function. The different features of the different embodiments can be combined with one another in any desired manner.

DETAILED DESCRIPTION OF THE EMBODIMENT(S)

Figure 1:
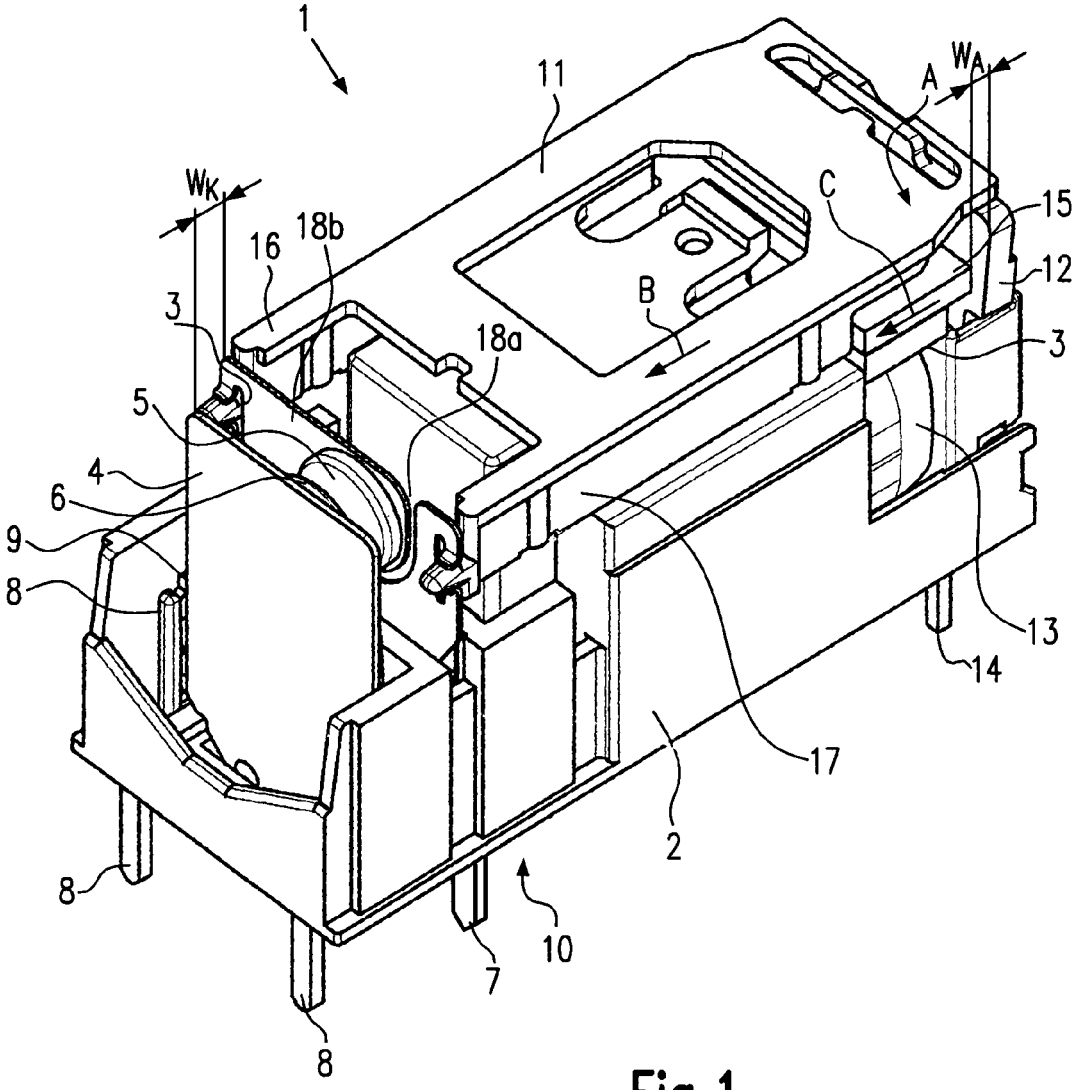
FIG. 1 is a perspective view of a first embodiment of a heavy duty relay according to the invention.

FIG. 1 shows a heavy duty relay 1 according to an exemplary embodiment of the invention. On a base 2 made from plastics material a changeover spring 3 and a normally-open spring contact 4 are held in the region of their lower edge in fastening points. These clamping regions are not described further. The changeover springs and the normally-open spring contacts 4 each form a clamped leaf spring. At the region lying opposite the fastening region the changeover spring 3 and the normally-open spring contact 4 are provided with contacts 5, 6, for example in the form of riveted contact beads.

The changeover springs 3 and the normally-open spring contacts 4 are manufactured from an electrically conductive material, such as for example a copper plate. The spring stiffness of the changeover spring 3 is lower than the spring stiffness of the normally-open spring contact 4. Preferably, the spring stiffness of the normally-open spring contact 4 is at least approximately 1.5 times and at most approximately 8 times the spring stiffness of the changeover spring, and more preferably approximately 3.5 to 5.5 times the spring stiffness of the changeover spring. This is achieved in the embodiment of FIG. 1, by the material thickness of the changeover spring 3 being less than the material thickness of the normally-open spring contact 4. The material thickness of the normally-open spring contact 4 is between approximately 1.5 times and 6 times the material thickness of the changeover spring 3. In particular, the material thickness of the normally-open spring contact is approximately 0.25 mm, while the material thickness of the changeover spring is approximately 0.15 mm.

The changeover spring 3 is electrically conductively connected to terminal contacts 7 and the normally-open spring contact 4 to terminal contacts 8. The terminal contacts 7, 8 protrude outwardly out of the relay from a base plate of the base 2 and allow the connection of electrical conductors which are connected to one another or separated depending on the switching position of the heavy duty relay. The changeover spring 3 and/or the normally-open spring contact 4 is in electrically conductive contact with the respective terminal contact 7, 8 associated therewith at terminal points 9. The conductors (not shown) to be switched by the heavy duty relay 1 are connected to the terminal points 7, 8, which conductors are electrically conductively connected to one another in the switching position.

The changeover spring 3 is rigidly connected via a preferably bar-shaped, longitudinally movable coupling part 11 to a movable armature 12. In the deflection direction between the armature 12 and the changeover spring 3, below the coupling part 11, a coil 13, indicated only diagrammatically in FIG. 2, extends parallel thereto. The coil 13 is actuated via a switching current which is conducted into the relay via switching terminals 14. The switching terminals 14 protrude, as do the terminal contacts 7, 8, terminals from the base plate of the base 2.

In order to minimize magnetic losses, a ferromagnetic core passes through the coil 13 and (on the armature side) continues in a yoke 15. Between the yoke 15 and the armature 12 a working air gap A is formed, so that the armature can tilt toward the yoke by the spacing of the working air gap. On its lower end, not visible in FIG. 1, the armature 12 is movably, preferably rotatably, mounted in the vicinity of the core through the coil 13. In order to minimise magnetic losses, the yoke 15 is curved in a U-shape and extends below the coil 13 parallel thereto. The lower end of the armature 12 forming a pivot axis rests on the lower end of the yoke, so that the armature is affected as little as possible with loss of magnetic flow.

If a switching current is conducted through the switching terminals 14, it flows through the coil 13 which produces a magnetic field and as a result pulls the armature 12 on the yoke 15 with a switching force C. The armature 12 tilts under the action of the switching force C toward the yoke 15, so that the working air gap A becomes smaller. Via the coupling part 11 held substantially translationally movably in the heavy duty relay 1, the movement of the armature 12 is transmitted to the changeover spring 3. In order to load the armature as evenly as possible and to guide the movement of the changeover spring 3 precisely, the coupling part 11 is fork-shaped on its end facing the changeover spring 3, the two fork ends 16, 17 introducing the switching force C into the changeover spring 3 approximately level with the contact 5 of the changeover spring 3 on both sides in the vicinity of the edge of the changeover spring 3.

By means of the fork-shaped construction, the switching force C is symmetrically conducted into the changeover spring 3, so that the switching movement is carried out without torsion. The coupling part 11 is preferably guided free of rotation in the heavy duty relay 1, so that possible rotational movements of the armature 12 and/or the changeover spring 3 cannot lead to a wedging of the coupling part 11 and a blocking of the heavy duty relay.

During the movement of the coupling part 11, under the action of the switching force C, the contact 5 of the changeover spring 3 is pressed into the switching position against the corresponding opposite contact 6 of the normally-open spring contact 4. In this state, the terminals 7 and 8 are conductively connected to one another via the changeover spring 3, the contact 5, the contact 6 and the normally-open spring contact 4. In the switching position the changeover spring 3 is resiliently deflected, so that when the inrush current ceases at the switching terminals 14, the coupling part 11 is pushed away from the yoke 15 together with the armature 12, due to the resilient return force of the changeover spring 3, and the working air gap A develops again in the resting position.

The size $W_A$ of the working air gap A in the direction of movement B of the coupling part 11 is greater than the spacing $W_K$ between the two contacts 5, 6 in this direction, so that a material erosion on the contacts 5, 6 occurring after many switching processes and an enlargement of the spacing between the contacts 5, 6 resulting therefrom cannot influence the function of the heavy duty relay 1. By means of the additional movement ($W_A$-$W_K$) such a material erosion is equalised. The heavy duty relay 1 of FIG. 1 is suitable for the switching of currents of at least 40 A to 1 kA. Due to the resiliently compliant construction of the normally-open spring contact it flexes in the switching position, when the changeover spring 3 is pressed against the normally-open spring contact 5 under the action of the switching force C. As a result even with a large additional movement of the changeover spring 3, the switching process can be carried out gently and chatter and sparking avoided at the contact points 5, 6.

Figure 2:
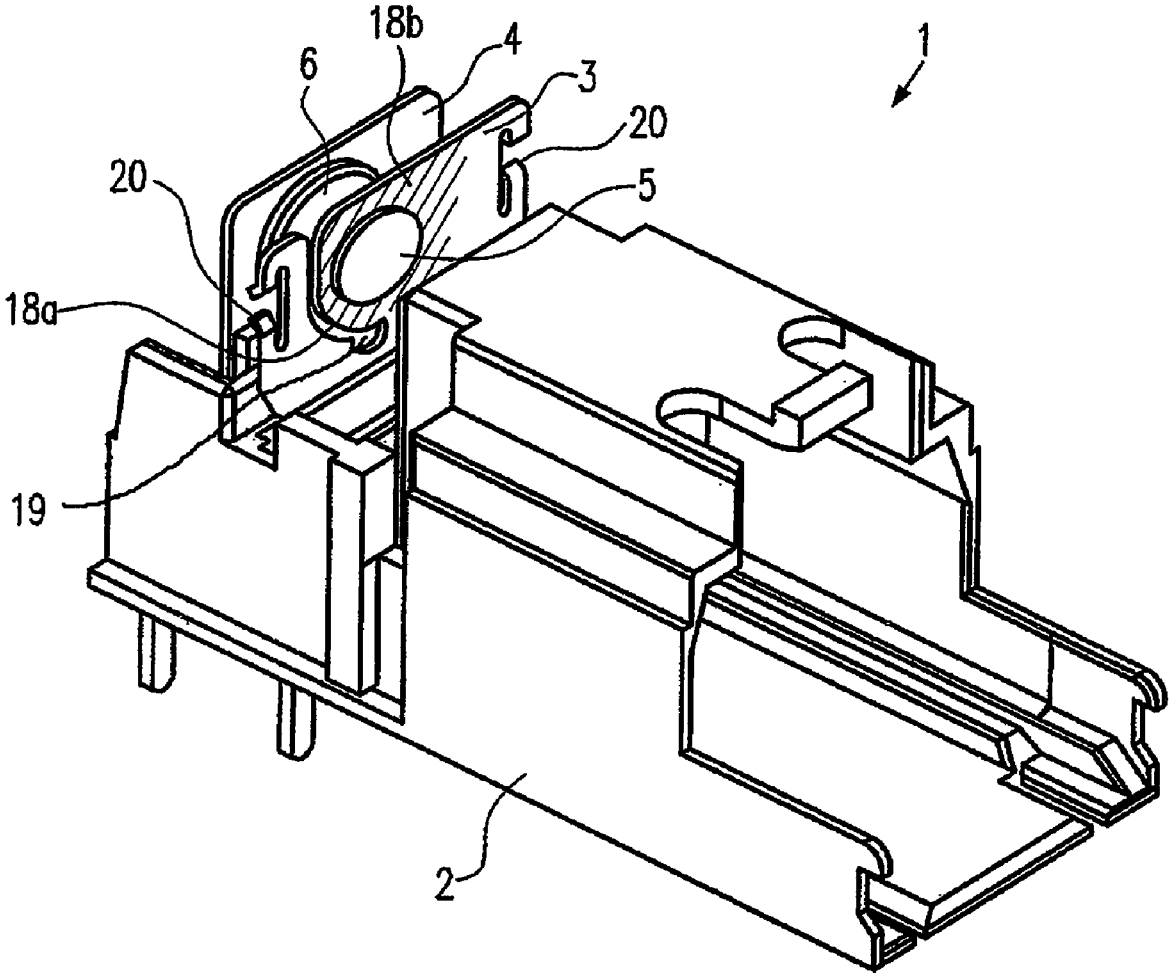
FIG. 2 is a perspective view of parts of a second embodiment of a heavy duty relay according to the invention.

On the changeover spring 3 a weakened zone 18*a* is provided by which the spring stiffness is asymmetrically reduced in a deflection region 18*b*. The construction and function of the weakened zone 18*a* are now disclosed with reference to FIG. 2. In FIG. 2 the magnet frame comprising the coil 13, the core in the vicinity of the yoke 15 in addition to the armature 12 and the coupling element 11 are omitted for clarity. Only the base 2 with the changeover spring 3 and the normally-open spring contact 5 are shown. With respect to the omitted elements, in the embodiment of FIG. 2 there is no difference to the embodiment of FIG. 1.

The deflection region 18*b* is shown shaded in FIG. 2 and surrounds the contact 5. As can be seen in FIG. 2, the weakened zone 18*a* is constructed in the form of a slot extending asymmetrically laterally and below the contact bead. On the end of the slot located in the interior of the changeover spring 3, the slot comprises a rounded widening 19. By this measure cracks are avoided in the changeover spring after frequent switching processes.

The weakened zone 18*a* extends partially between the contact point 5 and at least one point of application 20, at which the switching force C is passed into the changeover spring 3. As can be seen in FIG. 2, the weakened zone 18*a* extends to the fork ends 16, 17 on only one side of the contact point 5. As a result, during the switching process in the deflection region, the changeover spring 3 carries out a tilting movement from the plane of the spring contact. During the tilting movement the contact beads 5, 6 roll over one another, so that the contact is gradually established and leads to self cleaning.

The changeover spring 3 and the normally-open spring contact 4 are constructed such that in the switching position, when the changeover spring 3 is pressed against the normally-open contact under the action of the switching force C, the changeover spring in the deflection region undergoes greater resilient deflection in the region of the contact point 5 than the normally-open spring contact in the region of the normally-open contact 6. In particular, the normally-open spring contact is deflected less than the changeover spring by between ⅛ and ½, preferably by ⅕.

Moreover, the function of the heavy duty relay 1 of FIG. 2 is the same as in the embodiment of FIG. 1.

In FIGS. 3 to 10 different embodiments of changeover springs 3 and/or normally-open spring contacts 4 are shown, as they can be used with the heavy duty relay 1 equipped according to the invention according to one of the embodiments of FIG. 1 or 2. The embodiment of FIGS. 3 to 6 are provided with a contact bead arranged asymmetrically relative to a centerline M of the spring contact 3. The embodiments of FIGS. 7 to 10 are provided with contact beads arranged symmetrically relative to the centerline M.

Although, the embodiments of FIGS. 3 to 10 can in principle be used both for the changeover spring 3 and for the normally-open spring contact 4, they are preferably used as changeover springs 3, as they require lower switching forces S for deflection due to their high flexibility and therefore allow heavy duty relays of more compact construction. Hereinafter in the description of the embodiments of FIGS. 3 to 10, for example, the reference numerals are used for the components of the changeover spring 3.

Figures 3, 4, 5, 6, 7, 8, 9, 10:
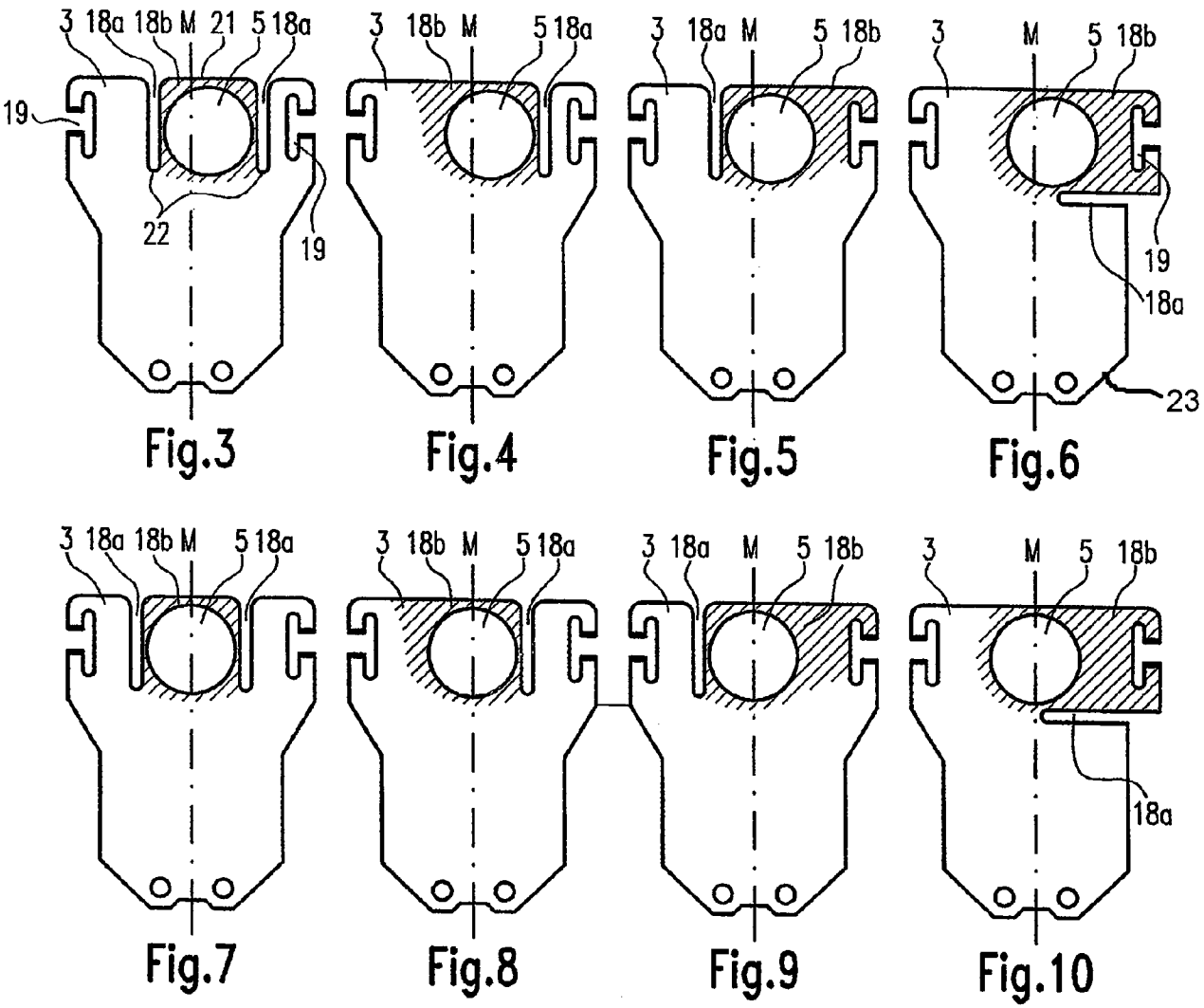
FIGS. 3 to 10 are front views of different embodiments of changeover springs and/or normally-open spring contacts for a heavy duty relay according to the invention.

By means of the contact bead 5 arranged asymmetrically relative to the centerline M in the embodiment of FIG. 3, the changeover spring 3 is loaded asymmetrically in the switching position in which it is pressed against the normally-open spring contact 4, so that it distorts. This distortion is increased in the embodiment of FIG. 3 by means of the weakened zones 18*a* arranged on both sides of the contact bead 5 and symmetrically arranged relative to the contact bead 5. Due to the asymmetrical arrangement of the contact bead 5 the weakened zone can be arranged symmetrically around the contact bead, as an asymmetry is already achieved in the cooperation of the contact bead 5 and the weakened zone 18*a*.

In the arrangement of FIG. 3 the contact bead 5 is arranged on a deflection region 18*b* forming a tab 21, which partially surrounds the two weakened zones 18*a* in the form of slots. In this manner the contact bead 5 is more easily movable than the rest of the changeover spring 3; the spring stiffness in the deflection region 18*b* is lower than the spring stiffness of the remaining spring contact. The weakened zones 18*a* are located between at least one point of application 19 for the switching force C and the contact tip 5.

FIGS. 4 and 5 show modifications of the embodiment of FIG. 3, only one weakened zone 18*a* being present respectively on one side of the contact bead, so that the direct flux of force is interrupted from only one of the points of application 19 to the contact 5. Moreover, by means of these measures a very asymmetrical flux of force is achieved by the changeover spring 3, which leads to distortion from its plane and a rolling of the contact bead. The deflection region 18*b* in these embodiments forms a triangular tab.

In the embodiment of FIG. 6 the weakened zone 18*a* is not arranged between the contact bead 5 and one or both of the two points of application 19 for the switching force S, but in the region between the contact 5 and the fastening points 23 with which the spring contact 3 is held on the base 2. In this embodiment the flux of force of the switching force C is passed directly to the contact bead, but the region between the points of application 19 and over the weakened zone can distort asymmetrically, as the contact point 5 can move freely in the region of the slot 18, while it is coupled in the remaining region to the movement of the changeover spring 3.

In FIGS. 7 to 10 the weakened zones 18*a* are relative to the contact point 5, as in FIGS. 3 to 6, so that for simplicity reference is made to the description of the embodiments of FIGS. 3 to 6. The rolling action is slightly reduced in the embodiments of FIGS. 8 to 10 relative to the embodiments of FIGS. 4 to 6, as the asymmetry of the resilient deflection due to the centrally arranged contact bead is no longer achieved exclusively by the weakened zone 18*a* arranged asymmetrically relative to the centerline M. As a result the asymmetrical loading of the coupling part 11 and the armature 12 is reduced.

In the embodiment of FIG. 7 with the weakened region arranged symmetrically around the contact bead 5, a symmetrical deflection of the contact bead 5 takes place with strongly restricted rolling movement. This embodiment can preferably be used with a mating contact, which is asymmetrically arranged and/or comprises asymmetrically arranged weakened zones.

In the embodiments of FIGS. 3 to 10 the weakened zones 18*a* are shown as rectilinear slots which extend from the edge of the changeover spring 3 adjacent to the contact bead 5 into the interior of the changeover spring 3. Instead of such a straight slot an arcuate slot can also be used, the curvature preferably following the form of the contact bead, as was already shown in the changeover spring of the embodiment of FIG. 2.

Naturally, modifications are possible in the construction of the heavy duty relay shown. The heavy duty relay can therefore have an asymmetrically constructed coupling part 11 or a coupling part 11 without fork-shaped ends. The armature 12 and the changeover spring 3 can also be located on the same side of the coil.

What is claimed is:

1. A heavy duty relay for switching a current of 40 A to 1 kA, comprising:

a changeover spring resiliently deflectable by means of a switching force and having a contact point;

a normally-open contact against which the contact point of the changeover spring is electrically conductively pressed in a switching position, the switching position being resiliently deflected out of a resting position, the normally-open contact being arranged on a normally-open spring contact having a greater spring stiffness than the changeover spring;

wherein at least one of the changeover spring and the normally-open spring contact have a deflection region at least partially surrounded by a weakened zone, such that the spring stiffness is reduced in the deflection region relative to the region surrounding the weakened zone, the weakened zone being constructed as a pair of slots, each of the slots extending in a direction of a line of symmetry of the changeover spring or the normally-open spring contact.

2. The heavy duty relay according to claim 1, wherein the spring stiffness of the normally-open spring contact is at most approximately 8 times the spring stiffness of the changeover spring.

3. The heavy duty relay according to claim 2, wherein the spring stiffness of the normally-open spring contact is at most approximately 5.5 times the spring stiffness of the changeover spring.

4. The heavy duty relay according claim 1, wherein the spring stiffness of the normally-open spring contact corresponds at least to the spring stiffness of the changeover spring.

5. The heavy duty relay according to claim 1, wherein the material thickness of the normally-open spring contact is at most approximately 6 times the material thickness of the changeover spring.

6. The heavy duty relay according to claim 5, wherein the material thickness of the normally-open spring contact is at least approximately 1.5 times the material thickness of the changeover spring.

7. The heavy duty relay according to claim 6, wherein the material thickness of the normally-open spring contact is in about 0.25 mm.

8. The heavy duty relay according to claim 7, wherein the material thickness of the changeover spring is in the region of 0.15 mm.

9. The heavy duty relay according to claim 1, wherein at least one contact point of the changeover spring or the normally-open spring contact is provided with a contact bead, the surface of the substantially spherically arcuate contact bead protruding from the plane of the changeover spring or the normally-open spring contact.

10. The heavy duty relay according to claim 9, wherein the contact bead is arranged asymmetrically displaced relative to the line of symmetry of the changeover spring or normally-open spring contact.

11. The heavy duty relay according to claim 1, wherein the weakened zone is asymmetrically arranged relative to a line of symmetry of the changeover spring or normally-open spring contact.

12. The heavy duty relay according to claim 11, wherein one slot is arranged on each side of the contact point between a force application point for the switching force and the contact point.

13. The heavy duty relay according to claim 11, wherein the weakened zone substantially follows the contour of the contact point.

14. The heavy duty relay according to claim 11, wherein the contact bead is arranged in the deflection region.

15. The heavy duty relay according to claim 11, wherein the weakened zone is arrange on the changeover spring.

16. A heavy duty relay for switching a current of 40 A to 1 KA, comprising:

a changeover spring resiliently deflectable by means of a switching force and having a contact point;

a normally-open contact against which the contact point of the changeover spring is electrically conductively pressed in a switching position, the switching position being resiliently deflected out of a resting position, the normally-open contact being arranged on a normally-open spring contact having a greater spring stiffness than the changeover spring;

wherein at least one of the changeover spring and the normally-open spring contact have a deflection region at least partially surrounded by a weakened zone, such that the spring stiffness is reduced in the deflection region relative to the region surrounding the weakened zone, the weakened zone being constructed as a slot extending from a side of the changeover spring or the normally-open spring contact having a force application point for the switching force in a direction perpendicular to a line of symmetry of the changeover spring or the normally-open spring contact.

17. The heavy duty relay according to claim 16, wherein the weakened zone is arranged between the contact point and a fastening point of the changeover spring or the normally-open spring contact.

18. The heavy duty relay according to claim 16, wherein the weakened zone is asymmetrically arranged relative to the line of symmetry of the changeover spring or normally-open spring contact.

19. The heavy duty relay according to claim 16, wherein the contact point includes a contact bead, the contact bead being asymmetrically displaced relative to the line of symmetry of the changeover spring or normally-open spring contact.

20. The heavy duty relay according to claim 18, wherein the slot extends below the contact point.

* * * * *

UNITED STATES PATENT AND TRADEMARK OFFICE

CERTIFICATE OF CORRECTION

PATENT NO. : 7,358,839 B2
APPLICATION NO. : 11/046313
DATED : April 15, 2008
INVENTOR(S) : Rudolf Mikl It is certified that error appears in the above-identified patent and that said Letters Patent is hereby corrected as shown below:

In column 9, line 22, claim 11, Delete "relative to a line of symmetry" should insert --relative to the line of symmetry--.

In column 9, line 35, claim 17, Delete "zone is arrange on the changeover" should insert --zone is arranged on the changeover--.

Signed and Sealed this

Twenty-second Day of July, 2008

JON W. DUDAS
*Director of the United States Patent and Trademark Office*